United States Patent [19]

Drost et al.

[11] 4,374,407

[45] Feb. 15, 1983

[54] BALLAST MOUNTING MEANS

[75] Inventors: Jim L. Drost; Myron K. Gordin, both of Oskaloosa, Iowa

[73] Assignee: Muscatine Lighting Mfg. Co., Inc., Muscatine, Iowa

[21] Appl. No.: 219,540

[22] Filed: Dec. 23, 1980

[51] Int. Cl.[3] ..... F21S 3/02

[52] U.S. Cl. ..... 362/432; 362/249; 362/368; 362/457

[58] Field of Search ..... 362/217, 225, 249, 250, 362/365, 366, 368, 426, 430, 432, 457

[56] References Cited

U.S. PATENT DOCUMENTS

| | | | |
|---|---|---|---|
| 3,872,296 | 3/1975 | Cohen et al. | 362/366 |
| 4,156,270 | 5/1979 | Beatty | 362/457 X |
| 4,190,881 | 2/1980 | Drost et al. | 362/396 X |
| 4,283,758 | 8/1981 | Irving et al. | 362/249 X |
| 4,285,033 | 8/1981 | Hart | 362/368 X |
| 4,327,403 | 4/1982 | Capostagno et al. | 362/368 X |

*Primary Examiner*—Peter A. Nelson

*Attorney, Agent, or Firm*—Rudolph L. Lowell; Brian G. Pingel

[57] ABSTRACT

A luminaire ballast mounting means for mounting ballast in a housing having a flat side wall includes a pair of linear rods that extend through a corresponding pair of openings arranged in a spaced relation along one side of the ballast. One pair of adjacent projected rod end sections is received within and in bearing engagement with a support member secured to the housing side wall and the other pair of projected rod end sections is engageable with a clamping means carried on the housing side wall and operable to move the other pair of rod end sections toward the side wall. When thus moved, the rods are flexed between the support member and clamping means to positions wherein the ballast is clamped against the housing side wall.

5 Claims, 5 Drawing Figures

BALLAST MOUNTING MEANS

BACKGROUND OF THE INVENTION

Lighting fixtures for industrial and recreational use generally include high intensity discharge luminairies such as mercury vapor lamps or high pressure sodium lamps. Such high intensity discharge luminairies generally have a ballast housing for containing the transformers and capacitors required for their operation as shown for example in U.S. Pat. No. 4,190,881. The transformers or ballasts are commercially available with or without specified mounting brackets and the like which are incorporated by the manufacturer in the ballasts so as to form an integral assembly therewith.

Ballasts are also commercially available with holes extended therethrough for receiving support or mounting bolts by which the ballasts are secured to a bracket or to a side wall of the ballast housing. These mounting bolts are extended through holes formed in the side wall. This manner of securing the ballasts not only permits rusting of the bolts and the side wall but the projection of the bolts exteriorly of the housing provides obstruction that interfere with the convenient handling of and working about the housing. In many instances the ballasts interfere with access to the mounting bolts so as to appreciably increase the time and cost of mounting the ballasts in, or removing the ballasts from, the housing therefor. It is desirable, therefore, that the mounting of a ballast within, and removal from, the housing be made relatively simple, inexpensive and quick.

SUMMARY OF THE INVENTION

The ballast mounting means of this invention for supporting a ballast within a housing is economical in cost, simple to install and efficient in use to positively secure a ballast in a desired location. The ballast mounting means is carried within the housing so as to eliminate any portions thereof being projected outwardly from the housing or exposed to the atmosphere. One type of commercially available ballast is provided with a pair of spaced holes extended therethrough and along one side thereof. These holes are utilized to receive a pair of corresponding linear rods, the end portions of which project outwardly from opposite ends of the ballast holes. One of the rod end sections is carried within and in bearing engagement with a support member that is secured to the inner surface of one side wall of the housing. The opposite rod end portions are engageable by a clamping means that is also secured to such inner surface for movement thereby toward the sidewall. This clamping movement flexes the rods, between the support member and the clamping means, to positions wherein the ballast is rigidly clamped against the housing side wall. To remove the ballast, it is only necessary to loosen the clamp means and lift the rods out of engagement with the support member.

DESCRIPTION OF THE INVENTION

Figure 1:
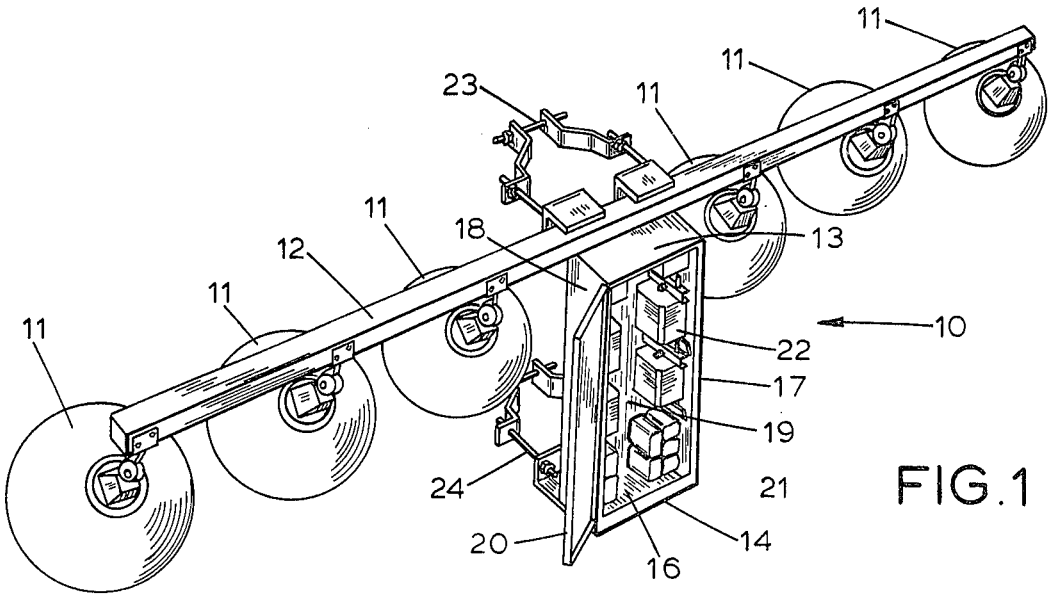
FIG. 1 is a rear perspective view of a light assembly showing the ballast mounting means of this invention in assembly relation with a ballast and a side wall of the housing.

Referring to the drawings, there is shown in FIG. 1, a light assembly 10 of high discharge luminaries 11 carried on a cross arm 12 for mounting on a pole (not shown) alone or in a stacked relation with similar light assemblies 10. The cross arm 12 has a central portion, secured as by welding, to the top wall 13 of a ballast housing 14 that also has a bottom wall 16, side walls 17 and 18, a front wall 19 and a hinged rear cover wall 20. A plurality of capacitors 21 and ballasts or transformers 22 are mounted within the housing 14 in operative association with corresponding luminaries 11. A pair of pole clamps 23 and 24 provide for a releasable attachment of the assembly 10 to a light pole. For a detailed description of the assembly 10, reference is made to U.S. Pat. No. 4,190,881.

Figure 4:
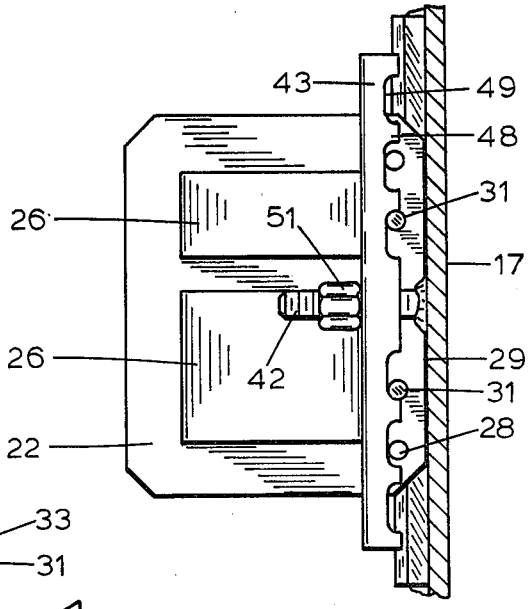
FIG. 4 is a top plan view of the assembly shown in FIG. 2.

Each ballast or transformer 22 (FIG. 5) is commercially available, such as for example, from Sola Electric of Elk Grove Village, Ill. 60007, and includes coils 26 carried within associated stacked laminations 27 which form the body member of the ballast 22. A series or row of holes 28 are spaced longitudinally of, and extended through, the laminations 27 along the ballast side surface 29 and in a substantially parallal relation therewith (FIG. 4). The holes 28 may vary in number and are provided to receive support bolts (not shown).

In the present invention, a selected pair of the holes 28 is utilized to receive therethrough a corresponding pair of linear mounting rods 31 (FIG. 3) of a length such that the end sections 32 and 33 of the rods project outwardly from opposite ends of a corresponding hole 28. As illustrated, the rods 31 are of a cylindrical shape with the end sections 32 having terminal flat portions 25 defined by a shoulder 30.

Cooperating with the rods 31 to mount a ballast 22 within the housing 14 and on the side wall 17 thereof is an elongated flat support member 34 (FIGS. 3 and 5) extended transversely of the side wall. One side edge 36 of the support member 34 is secured, as by welding, to the inner surface 37 of the side wall 17 so that its opposite edge 38 is spaced from such side wall to form with the opposite facing portion of the inner surface 37 a V-shape trough 39.

Figure 2:
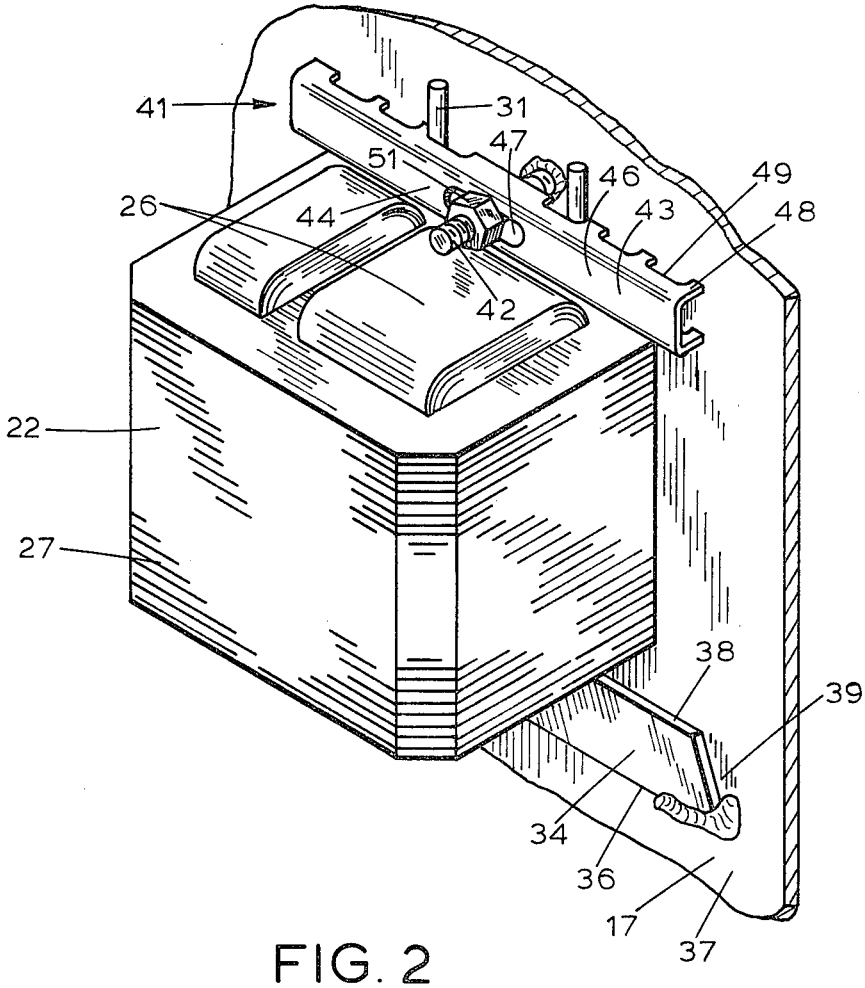
FIG. 2 is an enlarged detail perspective view of the ballast assembly shown generally in FIG. 1.
Figure 5:
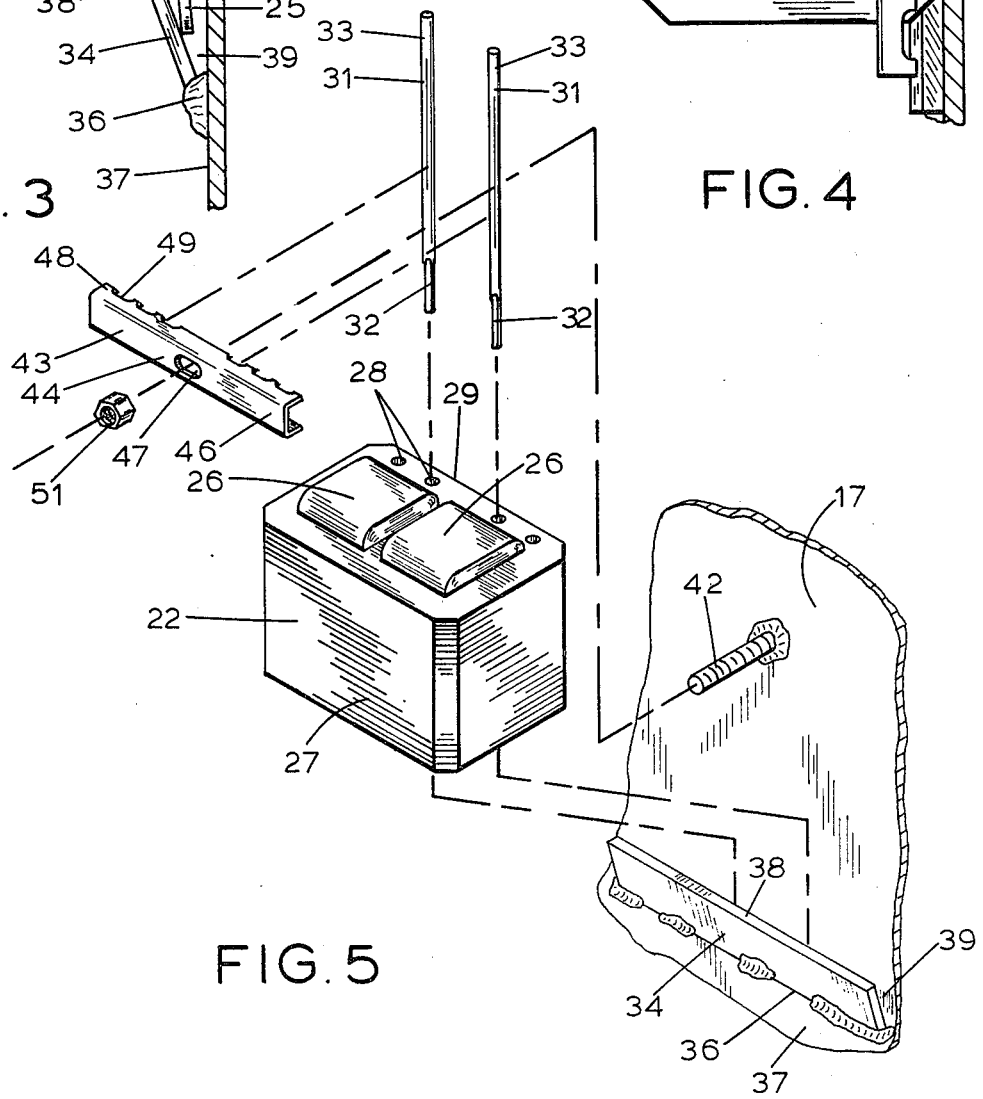
FIG. 5 is a reduced exploded view of the assembly shown in FIG. 2.

In a spaced relation from the supporting member 34, to provide for the positioning of a ballast 22 therebetween, is a clamping means 41 (FIG. 2) that includes a screw member 42 secured as by weldments to the inner surface 37 of the wall 17 and projected inwardly from the side wall 17. As shown in FIGS. 4 and 5, the screw member 42 is centrally placed with respect to the selected pair of holes 28 and the longitudinal dimension of the support member 34. An elongated clamp member 43 (FIG. 2) of a generally channel shape in transverse cross section has a central portion 44 formed in the base 46 thereof with a longitudinally extended slot 47 for receiving the screw member 42 when the clamp member 43 is open to the side wall 17. The legs 48 of the clamp member are formed with transversely opposite notches 49 in a spaced relation corresponding to the space between the ballast holes 28.

In the mounting of a ballast 22, on the housing side wall 17, the terminal flat portions 25 of the rod end sections 32 are placed within the trough 39. The ballast 22 is then moved to a position adjacent the inner surface 37 of the housing side wall with the rod end sections 33 to opposite sides of the screw member 42. The clamp member 43 is then assembled with the screw member 42 at the slot 47 and positioned to locate a pair of the notches 49 to receive therein the rod end sections 33. A clamping nut 51 is then threadable on the screw member 42 to engage and move the clamp member 43 and support member 34 and is facilitated by the increased flexing action which occurs at the shoulder 30 that defines the inner end of a flat portion 25 on a rod end section 32.

Figure 3:
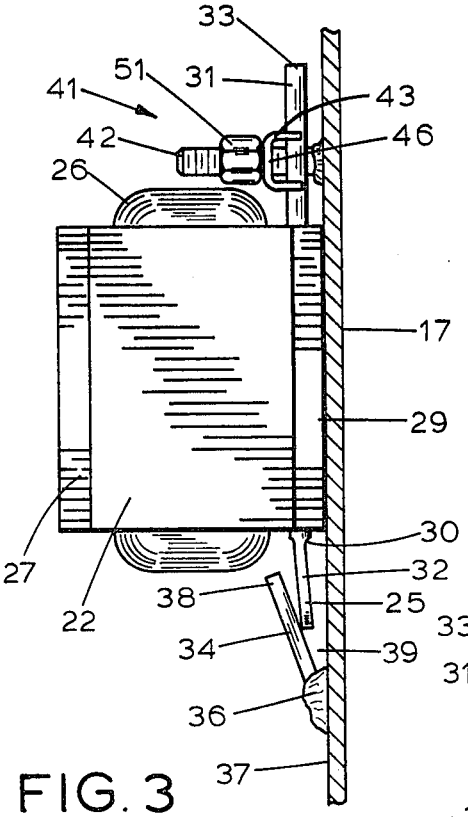
FIG. 3 is a side elevational view of the assembly shown in FIG. 2.

As shown in FIGS. 3 and 4, the mounting means of this invention is located entirely within the housing 14 without requiring any drilling of holes in the housing side wall. The single screw member 42 and nut 51 is readily accessible from the rear side of the housing 14 for easy manipulation. In the event the ballast 22 is to be replaced it is only necessary to remove the nut 51 and clamp member 43 after which the ballast 22 may be moved along the support member 34 and outwardly from the housing. The mounting of the ballast 22 within the housing and its removal therefrom is thus easily accomplished with a minimum of effort.

Although the invention has been described with a preferred embodiment thereof, it is to be understood that it is not to be so limited since changes and modifications can be made therein which are within the full intended scope of this invention as defined by the appended claims.

We claim:

1. Means for mounting a ballast within a housing having a flat side wall and wherein the ballast is formed adjacent one side surface thereof with a pair of laterally spaced openings extended therethrough in a substantially parallel relation with said side surface, comprising:

(a) a pair of linear mounting rods corresponding to and extended through said openings having end sections projected outwardly from opposite ends of a corresponding opening, (b) means on said container side wall for receiving in supported positions therein a first pair of adjacent ones of said end sections, and (c) clamping means secured to and projected inwardly of said side wall for engaging and moving the second pair of adjacent ones of said end sections toward said side wall whereby the rods are flexed to positions wherein the ballast is rigidly clamped against said side wall.

2. Means for mounting a ballast in accordance with claim 1 wherein:

(a) said receiving means includes a flat elongated support member having a side edge secured to the inner surface of said side wall such that the opposite side edge thereof is spaced outwardly from said inner surface.

3. Means for mounting a ballast in accordance with claim 1, wherein:

(a) said clamping means includes a clamp member, and (b) said rods, when the one side of said ballast is adjacent the container side wall, has the first pair of the adjacent end sections thereof received within the space between said support member and said inner surface in bearing engagement with said support member, and the second pair of adjacent end sections thereof located between said clamp member and said inner surface.

4. The means for mounting a ballast in accordance with claim 3, wherein:

(a) said clamping means includes a screw member secured to and projected outwardly from said inner surface and said clamp member has an opening for receiving said screw member therethrough, and (b) a clamping nut threadable on said screw member for engaging and moving said clamp member into and out of clamping engagement with said second pair of adjacent rod end sections.

5. The means for mounting a ballast in accordance with claim 3, wherein:

(a) said clamp member on the side thereof facing said second pair of adjacent rod end sections has a pair of rod receiving portions spaced a distance apart equal substantially to the distance between the openings in the ballast.

* * * * *